US009515433B2

(12) United States Patent
Li et al.

(10) Patent No.: US 9,515,433 B2
(45) Date of Patent: Dec. 6, 2016

(54) EARPHONE SOCKET, EARPHONE PLUG, EARPHONE AND ELECTRONIC DEVICE

(71) Applicant: Xiaomi Inc., Beijing (CN)

(72) Inventors: Hui Li, Beijing (CN); Wei Sun, Beijing (CN); Jie Fan, Beijing (CN)

(73) Assignee: Xiaomi Inc., Beijing (CN)

( * ) Notice: Subject to any disclaimer, the term of this patent is extended or adjusted under 35 U.S.C. 154(b) by 0 days.

(21) Appl. No.: 14/799,286

(22) Filed: Jul. 14, 2015

(65) Prior Publication Data

US 2016/0164234 A1 Jun. 9, 2016

Related U.S. Application Data

(63) Continuation of application No. PCT/CN2015/077880, filed on Apr. 29, 2015.

(30) Foreign Application Priority Data

Dec. 8, 2014 (CN) ..... 2014 1 0746572

(51) Int. Cl.

| | |
|---|---|
| ***H01R 24/58*** | (2011.01) |
| *H01R 105/00* | (2006.01) |
| *H01R 13/11* | (2006.01) |
| *H01R 13/24* | (2006.01) |
| *H01R 13/6471* | (2011.01) |
| *H01R 24/22* | (2011.01) |

(52) U.S. Cl.

CPC ..... *H01R 24/58* (2013.01); *H01R 13/111* (2013.01); *H01R 13/2485* (2013.01); *H01R 13/6471* (2013.01); *H01R 24/22* (2013.01); *H01R 2105/00* (2013.01); *H04R 2420/00* (2013.01)

(58) Field of Classification Search

CPC ..... H01R 24/58; H01R 2103/00
USPC ..... 439/668, 669
See application file for complete search history.

(56) References Cited

U.S. PATENT DOCUMENTS 3,829,814 A * 8/1974 Straus ..... E21B 17/028 439/101
5,593,323 A * 1/1997 Dernehl ..... H01R 13/717 439/638

(Continued)

FOREIGN PATENT DOCUMENTS

CN 2831490 Y 10/2006
CN 200972982 Y 11/2007

(Continued)

OTHER PUBLICATIONS

International Search Report and Written Opinion to PCT/CN2015/077880 dated Aug. 25, 2015 (5p).

(Continued)

*Primary Examiner* — Gary Paumen
(74) *Attorney, Agent, or Firm* — Quarles & Brady LLP

(57) ABSTRACT

The present disclosure relates to an earphone socket, an earphone plug, an earphone and an electronic device. For example, the earphone socket may include a socket body in which an earphone jack is formed. The earphone socket may include multiple ground terminals, which may be arranged in the earphone jack. The ground terminals may contact a ground section disposed on an earphone plug when the earphone plug is inserted into the earphone jack. The technical solutions of the present disclosure reduce earphone crosstalk and improve tone quality.

10 Claims, 5 Drawing Sheets

(56) References Cited

U.S. PATENT DOCUMENTS

| | | | | |
|---|---|---|---|---|
| 6,056,602 | A | 5/2000 | Wu | |
| 6,394,851 | B1 * | 5/2002 | Paciorek | B60N 3/14 439/668 |
| 6,609,931 | B2 * | 8/2003 | Parrish | H01R 13/17 439/108 |
| 6,947,766 | B2 * | 9/2005 | Chan | H01R 24/58 439/668 |
| 7,361,061 | B2 * | 4/2008 | Kim | H01R 24/58 439/668 |
| 7,824,230 | B1 | 11/2010 | Ho | |
| 7,833,066 | B2 | 11/2010 | Kao | |
| 7,887,376 | B1 * | 2/2011 | Zhang | H01R 13/6594 439/108 |
| 7,988,498 | B1 | 8/2011 | Lim et al. | |
| 2002/0037669 | A1 * | 3/2002 | D'Addario | H01R 13/17 439/669 |
| 2007/0123111 | A1 | 5/2007 | Chien et al. | |
| 2009/0081906 | A1 * | 3/2009 | Lynch | H01R 13/03 439/668 |
| 2010/0240259 | A1 | 9/2010 | Murphy et al. | |
| 2011/0076896 | A1 | 3/2011 | Jol | |
| 2014/0141655 | A1 * | 5/2014 | Do | H01R 13/187 439/669 |

FOREIGN PATENT DOCUMENTS

| | | | |
|---|---|---|---|
| CN | 201238132 | Y | 5/2009 |
| CN | 201256193 | Y | 6/2009 |
| CN | 101577389 | A | 11/2009 |
| CN | 201436735 | U | 4/2010 |
| CN | 101841588 | A | 9/2010 |
| CN | 201774085 | U | 3/2011 |
| CN | 102354862 | A | 2/2012 |
| CN | 202159851 | U | 3/2012 |
| CN | 102487470 | A | 6/2012 |
| CN | 102647644 | A | 8/2012 |
| CN | 104466544 | A | 3/2015 |
| DE | 102007031401 | A1 | 1/2009 |
| EP | 1115177 | A2 | 7/2001 |
| EP | 2706463 | A1 | 3/2014 |
| FR | 2860349 | A1 | 4/2005 |
| JP | 2001237031 | A | 8/2001 |
| KR | 101113592 | B1 | 2/2012 |
| KR | 20120124163 | A | 11/2012 |

OTHER PUBLICATIONS

First Office Action to Chinese Application No. 201410746572.4, dated Mar. 7, 2016 (6p).

European Search Report for European Application No. EP 15 19 2996 mailed Jul. 21, 2016 (10 pages).

Korean Office Action (including Original and English translation) dated Sep. 19, 2016 (9 pages).

* cited by examiner

EARPHONE SOCKET, EARPHONE PLUG, EARPHONE AND ELECTRONIC DEVICE

CROSS-REFERENCE TO RELATED APPLICATIONS

This application is a continuation of International Application No. PCT/CN2015/077880 with an international filing date of Apr. 29, 2015, which is based upon and claims priority to Chinese Patent Application No. 201410746572.4, filed Dec. 8, 2014, the entire contents of which are incorporated herein by reference.

TECHNICAL FIELD

The present disclosure relates to the field of earphones, and more particularly, to an earphone socket, an earphone plug, an earphone, and an electronic device.

BACKGROUND

Consumers prefer high sound quality from electronic devices such as an intelligent terminal. The tone quality of electronic devices can be diminished due to earphone crosstalk (CrossTalk).

SUMMARY

The present disclosure provides an earphone socket, an earphone plug, an earphone and an electronic device.

One general aspect includes an earphone socket, including a socket body in which an earphone jack is formed. The earphone socket also includes a plurality of ground terminals, which are on the earphone jack and contact a predetermined section disposed on an earphone plug in response to the earphone plug being inserted into the earphone jack.

Another general aspect includes an earphone plug, including a plug body. The earphone plug also includes a plurality of ground terminals arranged at a ground section disposed on the plug body, where the ground terminals contact a common ground region on an inner wall of an earphone jack when the plug body is inserted into the earphone jack.

Another general aspect includes an earphone socket including a socket body in which an earphone jack is formed. The earphone socket also includes a common ground region on an inner wall of the earphone jack, the common ground region in contact with a plurality of ground terminals of a ground section on an earphone plug when the earphone plug is inserted into the earphone jack.

According to another aspect, there is provided an earphone, including an earphone plug according to any one of the foregoing aspects.

According to yet another aspect of the present disclosure, there is provided an electronic device, including an earphone socket according to any one of the foregoing aspects.

According to the technical solutions provided by the present disclosure, increase a contact area of ground terminals between an earphone plug and an earphone socket by setting the multiple ground terminals in contact with a ground section on the earphone plug, . Thus, a contact resistance between the earphone plug and the earphone socket is reduced, which reduces earphone crosstalk caused by the circuitry of an electronic device such as an intelligent terminal and the like to which the earphone plug is connected.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate embodiments consistent with the present disclosure, and together with the specification, serve to explain the principles of the present disclosure. The components in the figures are not necessarily to scale.

DETAILED DESCRIPTION

Reference will now be made in detail to examples that are illustrated in the accompanying drawings. The following description refers to the accompanying drawings in which the same numbers in different drawings represent the same or similar elements unless otherwise represented. The implementations set forth in the following description of examples do not represent all implementations consistent with the technical solutions. Instead, they are merely examples of devices and methods consistent with some aspects related to the technical solutions as recited in the appended claims.

Figure 1:
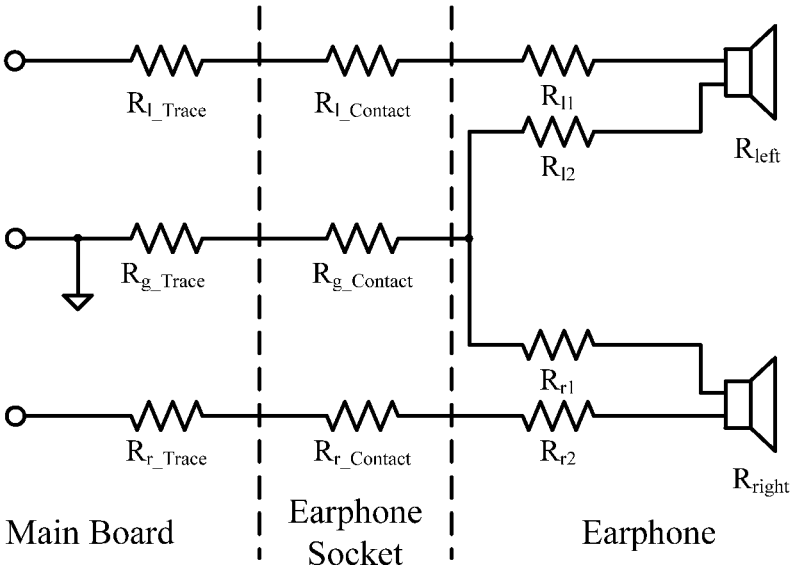
FIG. 1 is an example schematic diagram of resistance formed when an earphone is connected to an electronic device.

FIG. 1 is an example schematic diagram of resistance formed when an earphone is connected to an electronic device. $R_{1_TRACE}$, $R_{g_Trace}$ and $R_{r_Trace}$ are line resistances caused by wirings inside the electronic device. $R_{1_Contact}$, $R_{g_Contact}$ and $R_{r_Contact}$ are contact resistances produced between an earphone socket and an earphone plug. $R_{11}$ and $R_{12}$ as well as $R_{r1}$ and $R_{r2}$ respectively represent resistances introduced by line connections of left and right ear channels, while $R_{left}$ and $R_{right}$ are resistances of left and right channels respectively. The $R_{g_Trace}$ and $R_{g_contact}$ cause earphone crosstalk, and the produced earphone crosstalk may be calculated through the following equation (1):

$$\text{Crosstalk(dB)} = 20 \times \log\left[\frac{(R_{g_Trace} + R_{g_Conduct})\|R_{left}}{(R_{g_Trace} + R_{g_Conduct})\|R_{left} + R_{Right}}\right] \quad (1)$$

It can be seen from equation (1) that: the earphone crosstalk can be reduced through decreasing $R_{g_Trace}$ and $R_{g_contact}$. $R_{g_Trace}$ is the resistance introduced by wirings inside the electronic device, and the earphone crosstalk caused by this resistance can be reduced through manners such as shortening the wiring length, increasing the wiring area, introducing feedback signals and the like.

Figure 2:
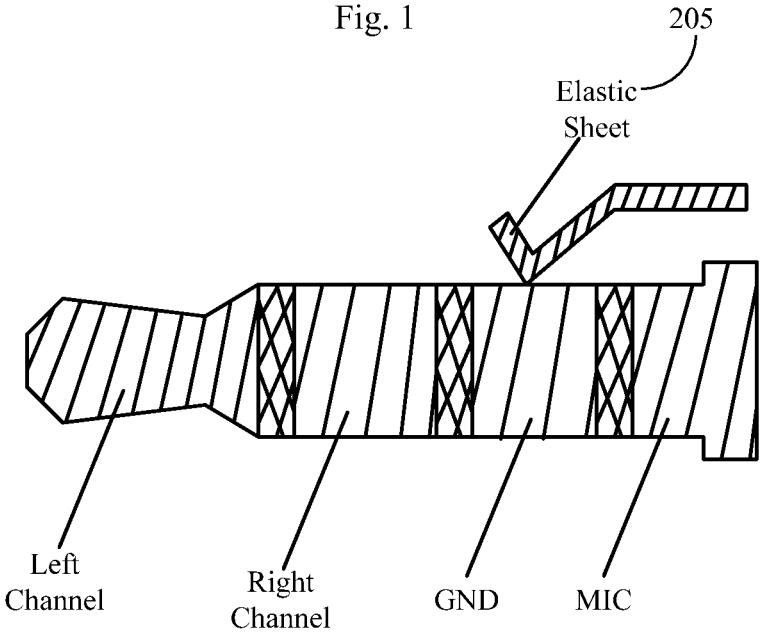
FIG. 2 is an example axial cross-sectional view when an earphone plug engages an earphone socket.

$R_{g_Contact}$ refers to the contact resistance produced when an earphone plug engages an earphone socket. For example, in the axial cross-sectional view when an earphone plug matches an earphone socket, as shown in FIG. 2, an elastic sheet 205 may be arranged in an earphone jack in the earphone socket. When the earphone plug is inserted into the earphone jack, the elastic sheet 205 may contact a GND end on the earphone plug to produce corresponding resistance $R_{g_Contact}$.

The technical solutions of the present disclosure provide structures of an earphone socket, an earphone plug, an earphone socket, and an electronic device, which reduce the resistance $R_{g_Contact}$.

I. Earphone Socket

Figure 3:
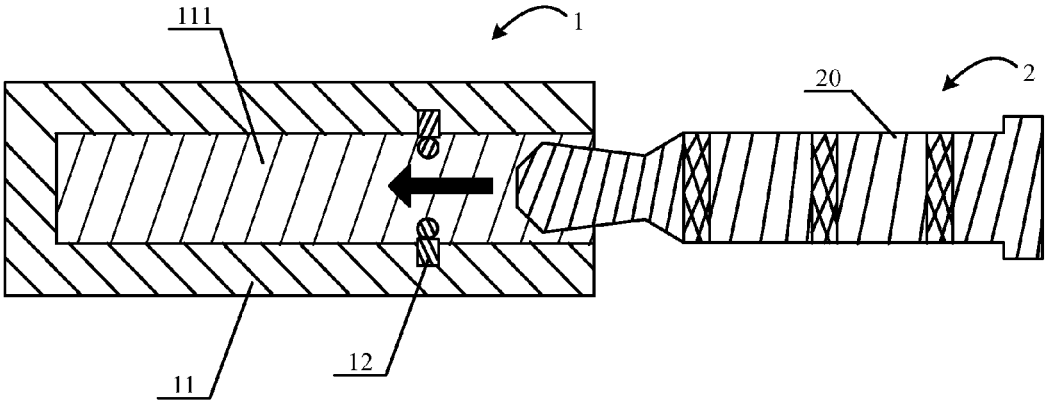
FIG. 3 is an example axial cross-sectional view when an earphone plug matches an earphone socket.

In one aspect, the present disclosure provides an earphone socket. FIG. 3 is an axial cross-sectional view when an earphone plug matches an earphone socket. The earphone socket 1 may include:

a socket body 11 in which a cavity or an earphone jack 111 may be formed; and multiple ground terminals 12, which may be arranged in the earphone jack 111, and which may contact a ground section 20 disposed on an earphone plug 2 when the earphone plug 2 is inserted into the earphone jack 111.

The ground section 20 is namely the GND end (as shown in FIG. 2) on the earphone plug 2. When the ground terminals 12 are in contact with the ground section 20, the above resistance $R_{g_Contact}$ may be produced. In the example shown in FIG. 2, the elastic sheet (equivalent to one ground terminal) being in contact with the GND end facilitates grounding. Instead, in the technical solutions of the present disclosure, by facilitating the ground terminals 12 to be in contact with the ground section 20 together, the corresponding contact area is increased to several times of that of the e, while the produced contact resistance $R_{g_Contact}$ is reduced to 1/N (N being the number of the ground terminals 12) of that in the example of FIG. 2.

In an example, the corresponding contact resistance is calculated with reference to equation (1). Since the resistance of the left and right channels of the earphone usually have the same values, for example, $R_{left}=R_{right}=R$, and $R_{g_Trace}$ may be reduced to a negligible order of magnitude through rational routing of wirings, equation (1) can be simplified as:

$$\begin{aligned}\text{Crosstalk(dB)} &= 20\times\log\left[\frac{R_{g_Conduct}\|R}{R_{g_Conduct}\|R+R}\right]\\ &= 20\times\log\left[\frac{R_{g_Conduct}}{2\times R_{g_Conduct}+R}\right]\\ &= 20\times\log(R_{g_Conduct})-20\times\log(2\times R_{g_Conduct}+R)\end{aligned}$$

Further, since R is far more than $R_{g_contact}$ ($R \gg R_{g_Contact}$), the above equation may be further simplified as:

$$\text{Crosstalk (dB)}=20\times\log(R_{g_conduct})-20\times\log(R)$$

For instance, if the number of the ground terminals 12 is eight (8), the earphone crosstalk may be reduced, $$\text{Crosstalk(dB)} = \left|20\times\log\left(\frac{1}{8}\right)\right| = 18\text{ dB},$$

and such a value of crosstalk produces a high tone quality of sound.

In the example earphone plug structure as shown in FIG. 2, the earphone plug may include four sections. A first section corresponding to left channel signals, a second section corresponding to right channel signals, a third section corresponding to a GND signal, and a fourth section corresponding to a MIC (Microphone). In another example earphone plug structure, the earphone plug may only include the third section corresponding to the GND signal and the fourth section corresponding to the MIC signal. In yet another example, the earphone plug may only include the first section corresponding to the left channel signals, the second section corresponding to the right channel signals, and the third section corresponding to the GND signal. Thus, several combinations are possible.

Those skilled in the art would understand that the technical solutions of the present disclosure are applicable in earphone plugs of all structures, and the ground terminals 12 may be employed in an earphone socket, thus improving tone quality by increasing the contact area with the earphone plug, reducing the corresponding contact resistance, and finally reducing the earphone crosstalk.

Structure of Ground Terminal

Figure 4:
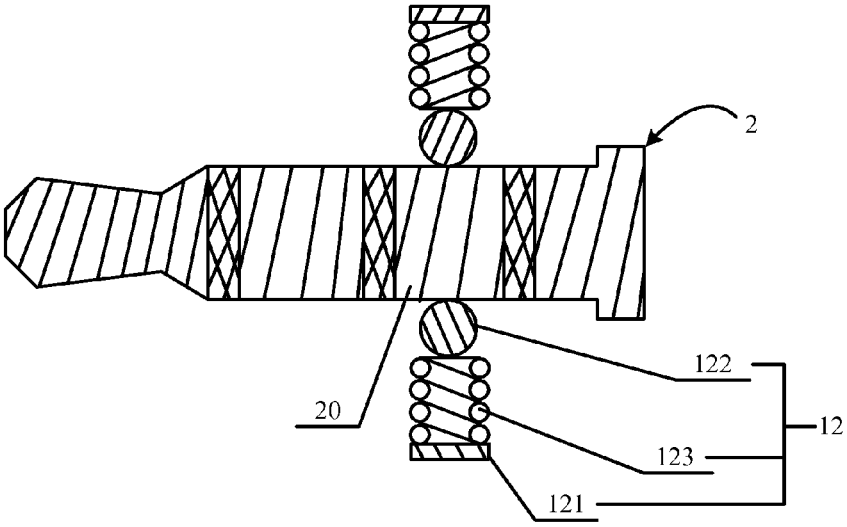
FIG. 4 is an example axial cross-sectional view when an earphone plug matches an earphone socket.

FIG. 4 illustrates an earphone plug inserted into the earphone jack. As shown in FIG. 4, once the earphone plug 2 is inserted into the earphone jack 111. The ground terminals 12 may all be in contact with the ground section 20 disposed on the earphone plug 2, respectively. A ground terminal from the ground terminals 12 may include at least a common ground structure 121, a header 122, and an elastic mechanism 123.

The common ground structure 121 may be arranged on an inner wall of the earphone jack 111. The header 122 may contact the earphone plug 2 when the earphone plug 2 is inserted into the earphone jack 111. The elastic mechanism 123 may be arranged between the common ground structure 121 and the header 122. The header 122 may be a globular metal structure, so as to realize reliable contact.

The elastic sheet structure as shown in FIG. 2, may produce an elastic force through self-mechanical deformation only, and the elastic force may be relatively weak. In case of the ground terminals 12 as shown in FIG. 4, a larger pressure may be provided through an independent elastic component 123 (for example, structures such as a spring and the like), so that the header the ground terminal is in contact with the ground section of the earphone plug 2 through a larger pressure. The produced contact resistance may therefore be further reduced further reducing the earphone crosstalk.

Since the ground section 20 is a small section on the earphone plug 2, distances of the plurality of ground terminals 12 from an end portion (the entrance or the bottom surface, not shown in figures) of the earphone jack 111 are the same along an insertion direction of the earphone plug 1 in order to ensure that all the ground terminals 12 can be accurately in contact with the ground section 20.

Figure 5:
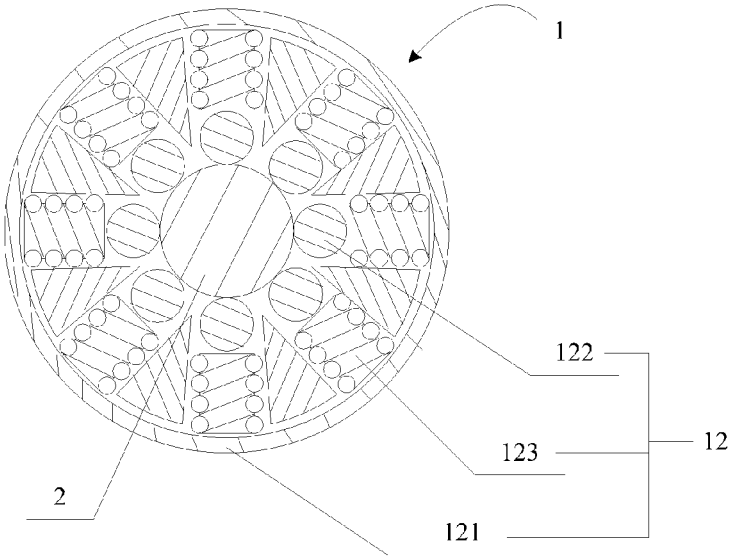
FIG. 5 is an example radial cross-sectional view when an earphone plug matches an earphone socket.

FIG. 5 is an example radial cross-sectional view showing the matching between the plurality of terminals 12 and the ground section 20 when the earphone plug 2 is inserted into the earphone jack 111. As shown in FIG. 5, the common ground structure 121 may be an annular metal structure arranged on an inner wall of the earphone jack 111.The inside of the common ground structure 121 may be in contact with the elastic mechanism 123 and the outside of the common ground structure 121 may be in contact with the main board (not shown in figures) of the electronic device.

In addition, all the ground terminals 12 may be uniformly arranged along a circumferential direction of the earphone jack 111, thus surrounding the earphone plug 2, and ensuring that all the ground terminals 12 may be in contact with the ground section 20 with a proper contact pressure.

Figure 6:
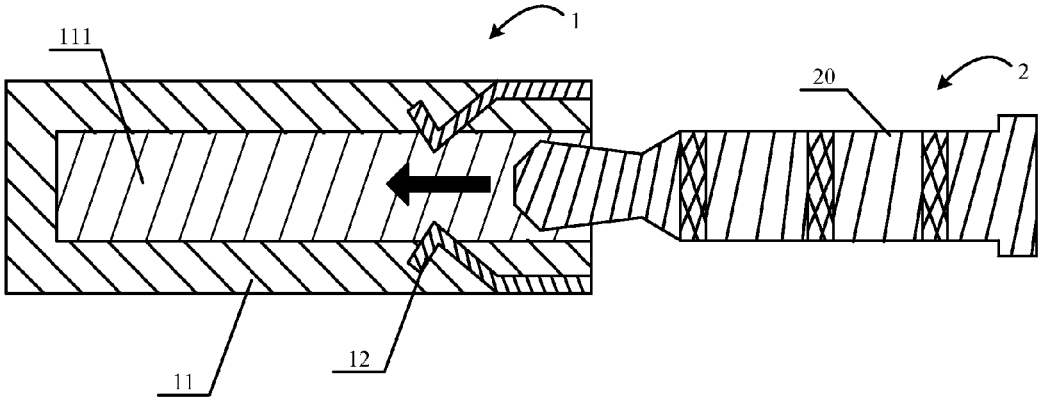
FIG. 6 is an example axial cross-sectional view when an earphone plug matches an earphone socket.
Figure 7:
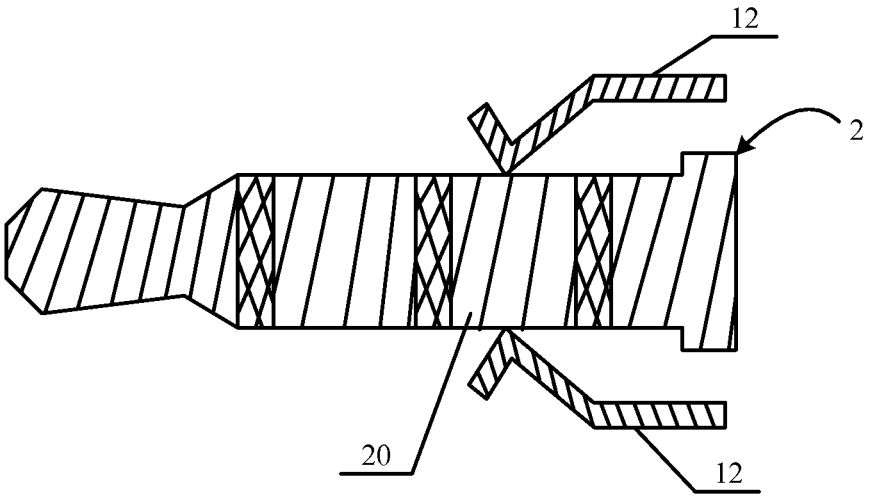
FIG. 7 is an example axial cross-sectional view when an earphone plug matches an earphone socket.

FIG. 6 illustrates an example mode of implementation. In the example of FIG. 6, the ground terminals 12 may have an elastic sheet structure arranged on an inner wall of the earphone jack 111. Accordingly, when the earphone plug 2 is inserted into the earphone jack 111, the plurality of ground terminals 12 can be as shown in FIG. 7. Meanwhile, under the elastic force produced by the self-mechanical deformation, the ground terminals 12 may be in contact with the ground section 20 on the earphone plug 2, thus increasing the contact area, decreasing the corresponding contact resistance, and reducing the produced earphone crosstalk.

II. Earphone Plug and Earphone Socket (I) Earphone Plug

Figure 8:
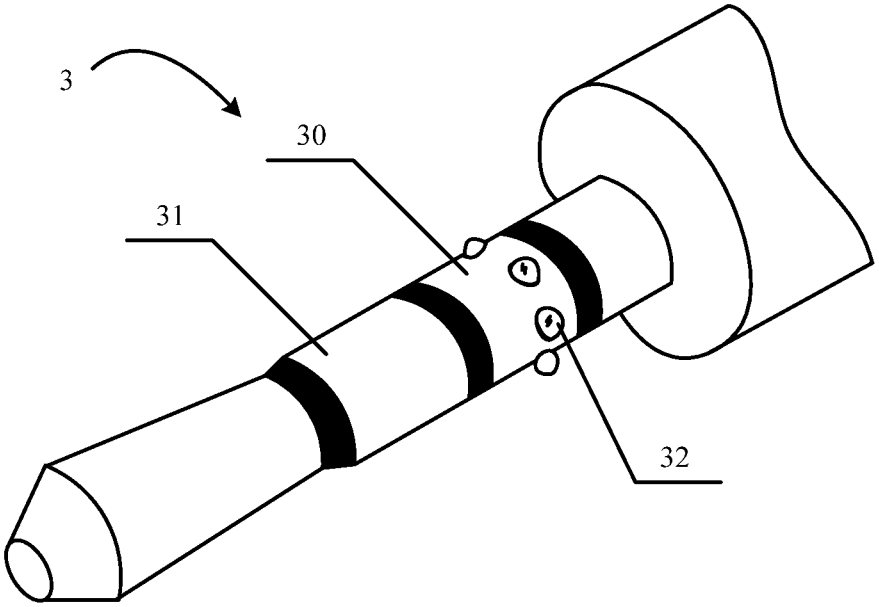
FIG. 8 is an example stereo view of an earphone plug.

In an example, an improved earphone plug and an earphone socket are concurrently described. FIG. 8 is a stereo view of an example earphone plug. As shown in FIG. 8, the earphone plug 3 may include a plug body 31, and multiple ground terminals 32.

The ground terminals 32 may be arranged at a ground section 30 disposed on the plug body 31. The ground terminal 12 may be capable of contacting a common ground region on the inner wall of the earphone jack when the plug body 31 is inserted into the earphone jack (not shown in the figure).

The ground terminals 32 may be arranged on the plug body 31 of the earphone plug 3, such that the ground terminals 32 may contact the common ground region of the earphone jack together. Thus the corresponding contact resistance may be decreased by increasing the contact area between the GND end of the earphone plug 3 and the common ground region of the earphone jack. In effect the earphone crosstalk may be reduced.

Since various signal transmissions need to be realized between the earphone plug 3 and the earphone socket after the earphone plug 3 is inserted into the earphone jack, the area of the common ground region may be limited. Further, all the ground terminals 32 may be in contact with the common ground region by placing all the ground terminals 32 at a predetermined distance from an end of the earphone plug 3 along an insertion direction of the earphone plug 3.

Figure 9:
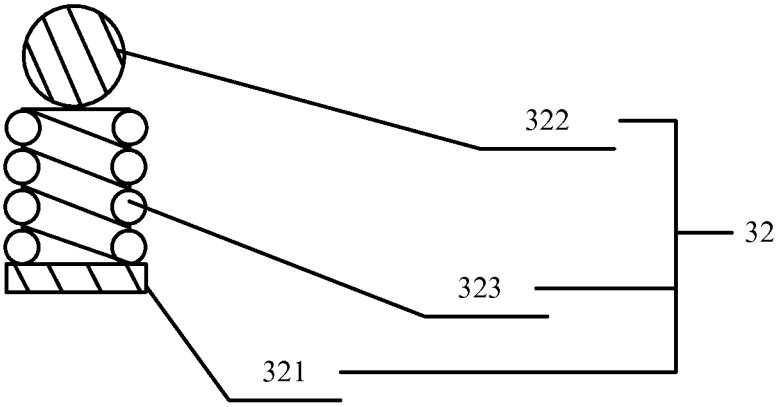
FIG. 9 is an example cross-sectional view of a ground terminal.

FIG. 9 is a cross-sectional view of a ground terminal. As shown in FIG. 9, each of the ground terminals 32 may include at least a common ground structure 321, a header 322, and an elastic component 323.

The common ground structure 321 may be arranged on the plug body 31. The header 322 may contact the common ground area when the earphone plug 3 is inserted into the earphone jack. The elastic component 323 may be between the common ground structure 321 and the header 322. The header 322 of each of the ground terminals 32 may be a globular metal structure, so as to realize reliable contact. The header may employ other structures in other examples.

The ground terminals 32, as shown in FIG. 4, provide a larger contact pressure for the ground terminals 32 by employing the independent elastic component 323 (for example, a spring, and the like), which may contribute to decreasing the contact resistance and thus reducing the earphone crosstalk.

Figure 10:
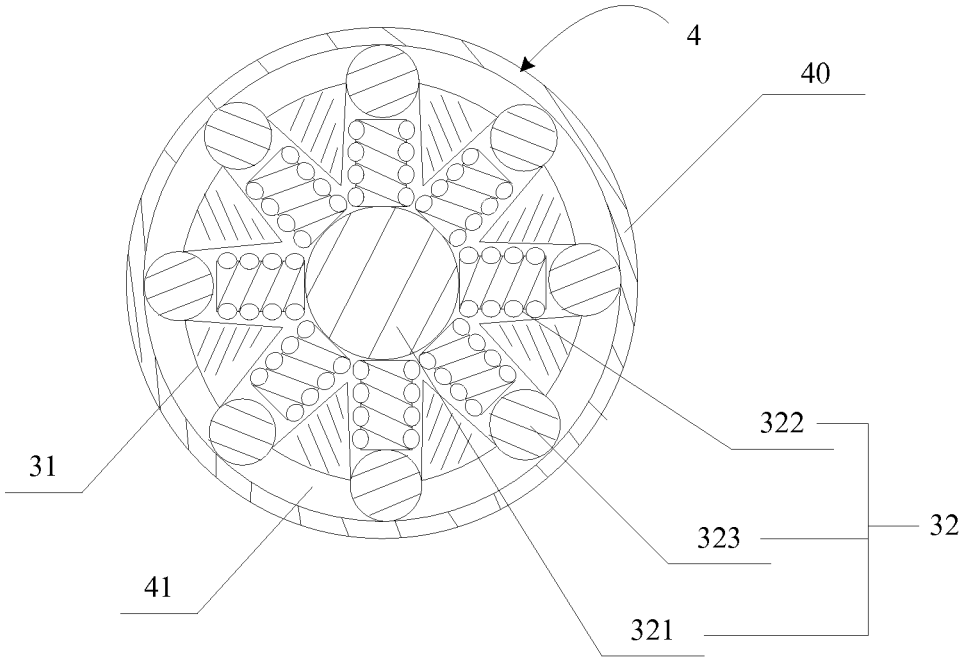
FIG. 10 is an example radial cross-sectional view when an earphone plug matches an earphone socket.

As shown in FIG. 10, an axial accommodating space may be formed inside the plug body 31. The common ground structure 321 may be located in the axial accommodating space (not shown in the figure). Additionally, radial openings (not shown in the figure) in communication with the axial accommodating space may be arranged on the plug body 31. The ground terminals 32 may be arranged in the radial openings respectively.

It can be seen from FIG. 10 that when the earphone plug 3 is inserted into an earphone jack 41 formed in an earphone socket 4, the ground terminals 32 on the earphone plug 3 may contact a common ground region 40 on an inner wall of the earphone jack 41. Thus, the contact area may be increased and the contact resistance may be reduced.

In addition, all the ground terminals 32 may be uniformly arranged along a circumferential direction of the earphone plug 3. The common ground region 40 may, thus, surround all the ground terminals 32, and thus all the ground terminals 32 may contact the ground section 40 with a proper contact pressure.

(II) Earphone Socket

As shown in FIG. 10, corresponding to the structure (I) of the above earphone plug 3, the present disclosure provides an earphone socket 4 that matches the earphone plug 3. The earphone socket may include at least a socket body, and a common ground region 40.

The socket body (not shown in the figure) is in which an earphone jack 41 is formed.

The common ground region 40 may be arranged on an inner wall of the earphone jack 41. The common ground region 40 may contact the ground terminals 32 at a ground section 30 on the earphone plug 3 when the earphone plug 3 (as shown in FIG. 8) is inserted into the earphone jack 41.

Alternatively, the common ground region 40 may be an annular metal structure.

The technical solutions of the present disclosure further includes an earphone, which may implement the example methods described throughout the present disclosure and may include hardware as described throughout the present disclosure.

The technical solutions of the present disclosure, also include an electronic device. The electronic device may include the earphone socket according to any one of the examples described throughout the present disclosure. For example, the electronic device may be a smartphone, a music player, a tablet computer, and the like.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are to be construed in the broadest sense, superseding any other implied definitions hereinbefore or hereinafter unless expressly asserted to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various examples have been described, it will be apparent to those of ordinary skill in the art that many more examples and implementations are possible. Accordingly, the examples described herein are not the only possible examples and implementations.

What is claimed is:

1. An earphone socket, comprising:

a socket body in which an earphone jack is formed; and a plurality of ground terminals, which are on the earphone jack and contact a predetermined section disposed on an earphone plug in response to the earphone plug being inserted into the earphone jack;

wherein each of the ground terminals comprises: a common ground structure on an inner wall of the earphone jack, a header that contacts the earphone plug when the earphone plug is inserted into the earphone jack, and an elastic component between the common ground structure and the header, and wherein the header of each of the ground terminals is a globular metal structure.

2. The earphone socket according to claim 1, wherein distances of each of the ground terminals from an end of the earphone jack are the same along an insertion direction of the earphone plug into the earphone socket.

3. The earphone socket according to claim 2, wherein the ground terminals are evenly spaced along a circumferential direction of the earphone jack.

4. The earphone socket according to claim 1, wherein each of the ground terminals comprises an elastic sheet structure.

5. An earphone plug, comprising:

a plug body; and a plurality of ground terminals arranged at a ground section disposed on the plug body, wherein the ground terminals contact a common ground region on an inner wall of an earphone jack when the plug body is inserted into the earphone jack;

wherein each of the ground terminals comprises: a common ground structure on the plug body, a header that contacts the common ground region when the earphone plug is inserted into the earphone jack, and an elastic component between the common ground structure and the header; and wherein an axial accommodating space is formed inside the plug body, and the common ground structure is located in the axial accommodating space; and a plurality of radial openings in communication with the axial accommodating space are further arranged on the plug body, and the ground terminals are arranged in each respective opening in the plurality of radial openings.

6. The earphone plug according to claim 5, wherein distances of the ground terminals from an end portion of the earphone plug are the same along an insertion direction of the earphone plug into the earphone socket.

7. The earphone plug according to claim 6, wherein the ground terminals are evenly spaced along a circumferential direction of the earphone plug.

8. The earphone plug according to claim 5, wherein the header of each of the ground terminals is a globular metal structure.

9. An earphone socket comprising:

a socket body in which an earphone jack is formed; and a common ground region on an inner wall of the earphone jack, the common ground region in contact with a plurality of ground terminals of a ground section on an earphone plug when the earphone plug is inserted into the earphone jack;

wherein each of the ground terminals comprises: a common ground structure on the plug body, a header that contacts the common ground region when the earphone plug is inserted into the earphone jack, and an elastic component between the common ground structure and the header; and wherein an axial accommodating space is formed inside the plug body, and the common ground structure is located in the axial accommodating space;

and a plurality of radial openings in communication with the axial accommodating space are further arranged on the plug body, and the ground terminals are arranged in each respective opening in the plurality of radial openings.

10. The earphone socket according to claim 9, wherein the common ground region is an annular metal structure.

* * * * *